US007184696B2

(12) United States Patent
Cokeley

(10) Patent No.: US 7,184,696 B2
(45) Date of Patent: Feb. 27, 2007

(54) PRINT FUSER AND PROCESS WITH MULTIPLE CLEANING BLADES

(75) Inventor: Jeffrey H. Cokeley, Byron, NY (US)

(73) Assignee: Eastman Kodak Company, Rochester, NY (US)

( * ) Notice: Subject to any disclaimer, the term of this patent is extended or adjusted under 35 U.S.C. 154(b) by 197 days.

(21) Appl. No.: 10/928,936

(22) Filed: Aug. 27, 2004

(65) Prior Publication Data

US 2006/0045584 A1 Mar. 2, 2006

(51) Int. Cl.
*G03G 15/20* (2006.01)

(52) U.S. Cl. ..... 399/327

(58) Field of Classification Search ..... 399/107, 399/122, 320, 327; 432/75
See application file for complete search history.

(56) References Cited

U.S. PATENT DOCUMENTS

| | | | | |
|---|---|---|---|---|
| 3,794,417 | A | 2/1974 | Machmer | |
| 3,935,836 | A | 2/1976 | Bar-on | |
| 3,940,238 | A | 2/1976 | Bar-on | |
| 3,941,085 | A | 3/1976 | Hattler et al. | |
| 3,986,227 | A | 10/1976 | Fathergill et al. | |
| 3,989,005 | A | 11/1976 | Bowler, Jr. et al. | |
| 4,165,965 | A * | 8/1979 | Bernardelli et al. | 432/75 |
| 4,367,690 | A * | 1/1983 | Sakaguchi et al. | 118/60 |
| 4,488,504 | A | 12/1984 | Vineski | |
| 5,043,768 | A | 8/1991 | Baruch | |
| 5,601,926 | A | 2/1997 | Moser | |
| 5,659,865 | A * | 8/1997 | Zarbo | 399/327 |
| 5,991,568 | A | 11/1999 | Ziegelmuller | |
| 6,704,536 | B2 * | 3/2004 | Nakayama | 399/328 |
| 2005/0019069 | A1 * | 1/2005 | Katayanagi et al. | 399/327 |

FOREIGN PATENT DOCUMENTS

GB 1 456 239 11/1976

* cited by examiner

*Primary Examiner*—Hoan Tran
(74) *Attorney, Agent, or Firm*—Donna P. Suchy

(57) ABSTRACT

The invention relates to cleaning deposits from rollers in a fusing apparatus for a printer. Fuser assemblies and processes for a printer are provided. According to just one aspect of the invention a support is provided. A fusing nip including a plurality of rollers is held by the support. A first roller of the plurality of rollers defines a circumferential surface and is rotatable about an axis in a direction of normal operation. A first cleaning blade is held by the support and defines a first edge in contact with the circumferential surface transverse to the direction of normal operation and is oriented such that rotating the first roller in the direction of normal operation applies a first pushing force to the first cleaning blade. A second cleaning blade is held by the support and defines a second edge in contact with the circumferential surface transverse to the direction of normal operation and is oriented such that rotating the first roller in the direction of normal operation applies a second pushing force to the second cleaning blade.

11 Claims, 1 Drawing Sheet

PRINT FUSER AND PROCESS WITH MULTIPLE CLEANING BLADES

BACKGROUND

The invention relates to cleaning deposits from rollers in a fusing apparatus for a printer.

Variable information may be added to media pre-printed, for example by offset lithography, using digital printing machines, such as the Digimaster® 9110 available from Nexpress Digital LLC, Rochester, N.Y. Pre-printed media may generate an unacceptable level of contamination of a fuser in a printer, and in particular, on an externally heated roller fuser. With pre-printed media generated by an offset printing process, the contamination is caused by transfer of offset inks and spray powder to the fuser components, and in particular the fuser roller. Such contamination typically causes image defects and release failure of printed/fused materials from the fuser roller. This results in frequent service calls to replace fuser parts.

DETAILED DESCRIPTION

Figure 1:
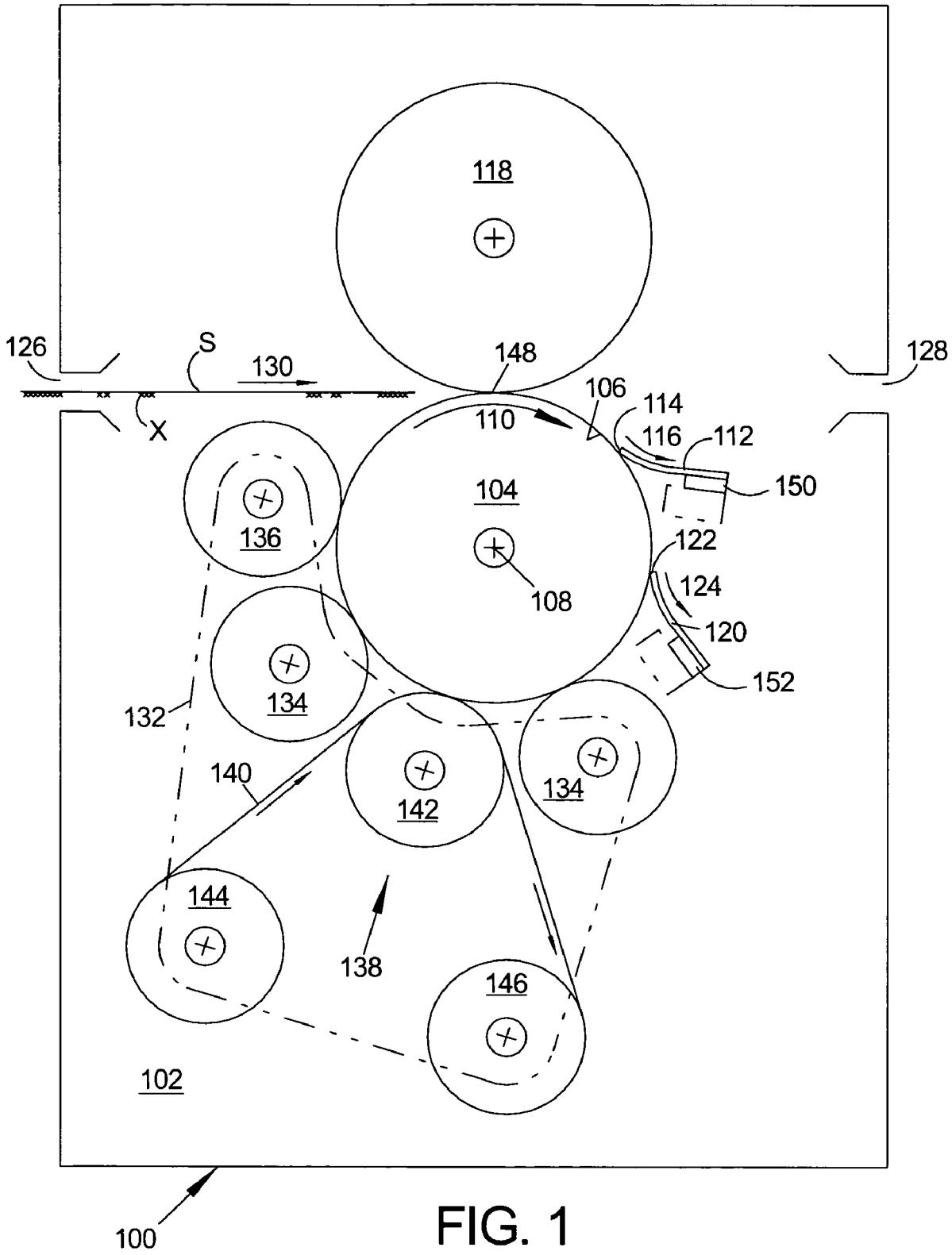
FIG. 1 presents a schematic end view of a fuser assembly and process according to various aspects of the invention.

Referring now to FIG. 1, which is not drawn to any particular scale, and wherein like components are numbered alike, a fuser assembly 100 for a printer is presented. As used herein, "first", "second", and "third" are used for reference only, do not indicate any particular order, and are not intended to limit the invention. The fuser assembly 100 comprises a support 102 and a roller 104 held by the support 102. Another roller 118 is provided held by the support 102 that forms a fusing nip 148 with roller 104. The roller 104 defines a circumferential surface 106 and is rotatable about an axis 108 in a direction of normal operation 110. The direction of normal operation 110 is the direction in which the fuser assembly 100 is configured to process media. A first cleaning blade 112 is held by the support 102 and defines a first edge 114 in contact with the circumferential surface 106 transverse to the direction of normal operation 110 and is oriented such that rotating the roller 104 in the direction of normal operation 110 applies a first pushing force 116 to the first cleaning blade 112. A second cleaning blade 120 is held by the support 102 and defines a second edge 122 in contact with the circumferential surface 106 transverse to the direction of normal operation 110 and being oriented such that rotating the roller 104 in the direction of normal operation 110 applies a second pushing force 124 to the second cleaning blade 120.

According to another aspect of the invention, a fusing process in a printer is provided comprising rotating the roller 104 held by the support 102 about the axis 108 in a direction of normal operation 110, the roller 104 defining a circumferential surface 106 and contacting another roller 118 at the fusing nip 148. The first cleaning blade 112 is by the support 102 and defines a first edge 114 in contact with the circumferential surface 106 transverse to the direction of normal operation 110 and being oriented such that rotating the roller 104 in the direction of normal operation 110 applies the first pushing force 116 to the first cleaning blade. The second cleaning blade 120 is held by the support 102 and defines a second edge 122 in contact with the circumferential surface 106 transverse to the direction of normal operation 110 and is oriented such that rotating the roller in the direction of normal operation 110 applies the second pushing force 124 to the second cleaning blade 120.

A sheet S enters the fuser assembly 100 from the left through entry 126, passes through the fusing nip 148, and exits the fuser assembly 100 to the right through exit 128. Other configurations and are contemplated in the practice of the invention, the particular configuration not being critical in the practice of the invention. The sheet S has ink particles X deposited on it, for example by inkjet, electrographic, or other means that apply ink particles X to the sheet S, and the ink particles X may comprise ink, dye, and/or toner (fusible dry ink). The sheet S passes between the rollers 104 and 118 under pressure and/or heat, in the direction of arrow 130. This process fixes the ink particles X to the sheet S, as is well known in the art. As used herein "fuser" and "fusing" refers to apparatus and processes for stabilizing an image on a receiver by heat and/or pressure. Appropriate sheet handling apparatus (not shown) is provided within the fuser that carries the sheet S from the entry 126, through the nip between the rollers 104 and 118, and to the exit 128.

According to a further aspect of the invention, the fuser assembly 100 for a printer is provided comprising the support 102 and a fusing surface (such as circumferential surface 106) held by the support 102 and movable in the direction of normal operation 110. The first cleaning blade 112 is held by the support 102 and defines a first edge 114 in contact the fusing surface transverse to the direction of normal operation 110 and is oriented such that moving the fusing surface in the direction of normal operation 110 applies the first pushing force 116 to the first cleaning blade 112. The second cleaning blade 120 is held by the support 102 and defines a second edge 122 in contact with fusing surface transverse to the direction of normal operation 110 and is oriented such that moving the fusing surface in the direction of normal operation 110 applies the second pushing force 124 to the second cleaning blade. Another example of a fusing surface is a fuser belt that defines the fusing surface. A fuser belt system is disclosed in U.S. Pat. No. 6,096,427 issued Aug. 1, 2000 to Chen et al. This patent is hereby incorporated in its entirety by reference as if fully set forth herein.

According to a further aspect of the invention, a fusing process in a printer is provided comprising moving the fusing surface (such as circumferential surface 106) held by the support 106 in the direction of normal operation 110. The first cleaning blade 112 is held by the support 102 and defines the first edge 114 in contact with the fusing surface transverse to the direction of normal operation 110 and being oriented such that moving the fusing surface in the direction of normal operation 110 applies a pushing force 116 to the first cleaning blade 112. The second cleaning blade 120 is held by the support 102 and defines the second edge 122 in contact with the fusing surface transverse to the direction of normal operation and is oriented such that moving the fusing surface in the direction of normal operation 110 applies a pushing force 124 to the second cleaning blade 120.

The circumferential surface 106, or fusing surface, may comprise material deposited from pre-printed media, for example offset ink and/or powder. The powder is applied to inhibit smearing, offsetting, and blocking in an offset printing process, as is described on pages 176 and 249–250 of Hemult Kipphan, HANDBOOK OF PRINT MEDIA (Springer 2001), and is residual on pre-printed media. According to one aspect of the invention, the first and second cleaning blades 112 and 120 remove such material.

The material of cleaning blades 112, 120, etc., may be any material capable of withstanding the heat and abrasiveness of the fuser and/or pressure rollers or other surface to which it is applied. One example of a suitable material is a thin spring steel between 0.002 and 0.006 inches thick. A 0.004 inch thick extra spring temper cold rolled steel strip may be implemented. The included angle of contact between the blade and a tangent to the surface at the point of contact with the moving surface 106 may be on the order of 0 to 30 degrees, inclusive, and may be on the order of 10 to 20 degrees, inclusive. The tip force perpendicular to the moving surface 106 at the point of contact may be on the order of 1 ounce to 5 ounces per linear inch, inclusive, and may be between 2 ounces and 4 ounces per linear inch, inclusive.

The support 102 may take any suitable configuration. It generally comprises a frame and is composed of numerous separate components although a simple fuser may have a monolithic support. The support 102 may comprise one or more additional supports 132 (shown in phantom). The components may be interconnected by bonding, welding, mechanical fastening, or any other suitable method. Such assemblies are typically fabricated for subsequent disassembly in order to provide ready access to replaceable parts.

A first mount 150 may be provided held by the support 102, the first cleaning blade 112 being held by the first mount 150. Likewise, a second mount 152 may be provided held by the support 102, the second cleaning blade 120 being held by the second mount 152. The mounts 150 and 152 may be separate, individual, structures, as shown in FIG. 1, and the cleaning blades 112 and 120 may be mounted thereto for ready removal and replacement. The mounts 150 and 152 may interconnected with the support 102, and components thereof, by bonding, welding, mechanical fastening, or any other suitable method. The cleaning blades 112 and 120 may be attached in a similar manner but, as stated previously, a removable configuration may be advantageous.

The fusing surface may be heated. Generally, heating is accomplished internally or externally. In the example of FIG. 1, a pair of heating rollers 134 are provided that contact the circumferential surface 106. The heating rollers 134 have internal radiant heaters, for example heat lamps. Any type of heating may be implemented in the practice of the invention.

Furthermore, a surface treatment may be applied to the circumferential surface 106 by a roller 136, as described in Provisional Patent Application Ser. No. 60/540,883 entitled "METHOD AND APPARATUS FOR VARIABLE WIDTH SURFACE TREATMENT APPLICATION TO A FUSER", filed Jan. 30, 2004, the contents of which are hereby incorporated by reference as if fully set forth herein. As described in that application the surface treatment may be a substance that promotes release of the fused sheet from the fuser roller 104, for example silicone oil. The roller 136 may be a porous wick roller, for example a porous ceramic cylinder covered with fabric. Silicone oil may be fed to it from a perforated tube disposed inside the ceramic cylinder.

Additional cleaning may be added, as described in Provisional Patent Application Ser. No. 60/582,482 entitled "VARIABLE FUSER FOR PRINT MEDIA", filed Jun. 24, 2004, the contents of which are hereby incorporated by reference as if fully set forth herein. In the embodiment of FIG. 1, a web cleaner 138 is provided that incrementally moves a web 140 over the surface of a tensioner roller 142 from a supply roll 144 to a take-up roll 146. An example of a web cleaner that may be implemented is described in U.S. Pat. No. 6,631,251, issued Oct. 7, 2003, entitled "Fuser web cleaning assembly for an electrophotographic machine", the contents of which are hereby incorporated by reference as if fully set forth herein. The web 140 may be comprised of any flexible, cleaning material which is capable of removing contaminants from fuser surface 106 upon contact (e.g. woven cloth-like material such as a NOMEX® aromatic polyamide fiber) without damaging it. Alternatively, or in addition, the web cleaner 138 may be applied to one or both heating rollers 134.

The heating roller 134, roller 136, and cleaning assembly 138, may be held by one or more additional supports 132 (shown in phantom in FIG. 1) that, in turn, are held by the support 102. The exact configuration is not critical in the practice of the invention to the extent that the components do not interfere with each other and the sheet S is free to move through the fuser assembly 100 without obstruction.

In the embodiments described herein with reference to FIG. 1, the roller 104 comprises a fuser roller but, according to a further aspect of the invention, the first cleaning blade 112 could also be applied to a pressure roller, such as roller 118. Furthermore, the first cleaning blade 112 could be applied to both fuser roller 104 and pressure roller 118. Likewise, the second cleaning blade 120 could be applied to both the fuser roller 104 and the pressure roller 118. It is intended for these variations to be included within the scope of the claims.

A fuser roller 104 may comprise a core, for example made of aluminum, and a cylindrical fusing blanket supported on the core. The blanket is typically made of an elastomeric material such as rubber particularly formulated to be heat conductive or heat insulative dependent upon whether the fuser heat source is located within the core or in juxtaposition with the periphery of the blanket. An example of a fuser roller is disclosed in United Patent Application Publication US 2004/0023144 A1, filed Aug. 4, 2003, in the names of Jerry A. Pickering and Alan R. Priebe, the contents of which are incorporated by reference as if fully set forth herein. The pressure member 118 may be similarly constructed, for example a metallic core (such as aluminum) covered by an elastomeric cushion (such as filled silicone elastomer), covered by a perfluoroalkoxy or tetrafluoroethylene plastic sleeve.

The cleaning blades of the invention may be mounted in numerous suitable ways, for example by retaining and/or clipping. The blades tend to heat during operation, so relatively large contiguous blades may be mounted in a manner that permits thermal expansion and contraction relative to the mount, for example a retainer with mounting holes elongated in a widthwise direction would allow the blade to expand and contract in the widthwise direction while remaining fully constrained. A retainer could be configured as a C-shaped channel. This may also be applied to narrower blades to the extent that relief for thermal expansion and contraction is desired.

Although described and illustrated with two cleaning blades, three or more cleaning blades may be implemented in the practice of the invention.

The cleaning blades may be configured as shown and described in application Ser. No. 10/928,935 filed on Aug. 27, 2004 entitled CLEANING DEVICE AND PROCESS WITH MULTIPLE CLEANING BLADES HELD BY A COMMON MOUNT, the entire contents of which are incorporated by reference as if fully set forth herein. The cleaning blades may also be configured as shown and described in application Ser. No. 10/928,934 filed on Aug. 27, 2004 entitled CLEANING DEVICE AND FUSER ASSEMBLY FOR A PRINTER WITH MULTIPLE CLEANING BLADES HELD BY A COMMON MOUNT, the entire contents of which are incorporated by reference as if fully set forth herein.

The claims should not be read as limited to the described order or elements unless stated to that effect. As used herein, "first", "second", and "third" are used for reference only, do not indicate any particular order, and are not intended to limit the invention. In addition, use of the term "means" in any claim is intended to invoke 35 U.S.C. §112, paragraph 6, and any claim without the word "means" is not so intended.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A fuser assembly for a printer comprising:

a support;

a fusing nip comprising a plurality of rollers held by the support, a first roller of the plurality of rollers defining a circumferential surface and being rotatable about an axis in a direction of normal operation wherein the first roller is a fuser roller;

a first cleaning blade held by the support and defining a first edge in contact with the circumferential surface transverse to the direction of normal operation and being oriented such that rotating the first roller in the direction of normal operation applies a first pushing force to the first cleaning blade; and a second cleaning blade held by the support and defining a second edge in contact with the circumferential surface transverse to the direction of normal operation and being oriented such that rotating the first roller in the direction of normal operation applies a second pushing force to the second cleaning blade.

2. The fuser assembly of claim 1 the circumferential surface comprising material deposited from pre-printed media.

3. The fuser assembly of claim 1 comprising: a first mount held by the support, the first cleaning blade being held by the first mount, a second mount held by the support, the second cleaning blade being held by the second mount.

4. A fusing process in a printer comprising:

rotating a fuser roller held by a support about an axis in a direction of normal operation and contacting another roller at a fusing nip, the roller defining a circumferential surface, a first cleaning blade being held by the support and defining a first edge in contact with the circumferential surface transverse to the direction of normal operation and being oriented such that rotating the fuser roller in the direction of normal operation applies a first pushing force to the first cleaning blade, and a second cleaning blade being held by the support and defining a second edge in contact with the circumferential surface transverse to the direction of normal operation and being oriented such that rotating the fuser roller in the direction of normal operation applies a second pushing force to the second cleaning blade.

5. The process of claim 4 the first and second cleaning blade removing material deposited on the circumferential surface from pre-printed media.

6. The process of claim 4 comprising:

a first mount held by the support, the first cleaning blade being held by the first mount.

a second mount held by the support, the second cleaning blade being held by the second mount.

7. A fuser assembly for a printer comprising:

a support;

a fusing surface comprising a fuser roller defining a circumferential surface held by the support, and rotatable about an axis in a direction of normal operation;

a first cleaning blade held by the support and defining a first edge in contact the fusing surface transverse to the direction of normal operation and being oriented such that moving the fusing surface in the direction of normal operation applies a first pushing force to the first cleaning blade; and a second cleaning blade held by the support and defining a second edge in contact with the fusing surface transverse to the direction of normal operation and being oriented such that moving the fusing surface in the direction of normal operation applies a second pushing force to the second cleaning blade.

8. The fuser assembly of claim 7 the fusing surface comprising material deposited from pre-printed media.

9. The fuser assembly of claim 7 comprising a belt that defines the fusing surface.

10. The fuser assembly of claim 7 comprising:

a first mount held by the support, the first cleaning blade being held by the first mount.

a second mount held by the support, the second cleaning blade being held by the second mount.

11. The fuser assembly of claim 7, comprising a heater that heats the fusing surface.

* * * * *